United States Patent [19]

Garchinsky

[11] 4,148,456

[45] Apr. 10, 1979

[54] ADJUSTABLE ARTICULATED POLE MOUNT ASSEMBLY

[75] Inventor: John S. Garchinsky, Aldan, Pa.

[73] Assignee: Gar Design Research, Inc., Aldan, Pa.

[21] Appl. No.: 806,744

[22] Filed: Jun. 15, 1977

[51] Int. Cl.[2] ..... A47B 96/06

[52] U.S. Cl. ..... 248/219.4; 248/231

[58] Field of Search ..... 248/218.4, 219.1, 219.2, 248/219.3, 219.4, 228, 229, 230, 231

[56] References Cited

U.S. PATENT DOCUMENTS

| | | | |
|---|---|---|---|
| 1,737,151 | 11/1929 | Derbyshire | 248/231 |
| 2,634,939 | 4/1953 | Voss | 248/231 |
| 2,726,058 | 12/1955 | Foltz | 248/231 |
| 2,754,944 | 7/1956 | Peterson | 248/231 |
| 3,241,800 | 3/1966 | Richter | 248/231 |
| 3,637,604 | 1/1972 | Schenavar | 248/231 |
| 3,917,205 | 11/1975 | Meadors | 248/229 |

*Primary Examiner*—Robert A. Hafer

*Attorney, Agent, or Firm*—Nelson E. Kimmelman

[57] ABSTRACT

An articulated mounting device for mounting an object such as traffic signals, signs or the like on vertical or horizontal poles or masts comprises a central apertured plate for attachment to the bracket holding the traffic signal, a first plurality of substantially identical pivotal links releasably coupled to one another and to one side of the central plate, and a second plurality of substantially identical pivotal links releasably coupled to one another and to the other side of the central plate, and two terminal portions respectively connected to the ends of said first and second pluralities not connected to the central plate for releasably coupling the ends of the device together around the pole or mast.

11 Claims, 9 Drawing Figures

ADJUSTABLE ARTICULATED POLE MOUNT ASSEMBLY

BACKGROUND OF THE INVENTION

1. Field of the Invention

This invention relates to mounting devices and in particular to an articulated mounting device for use in mounting traffic light assemblies on poles or the like.

2. Prior Art

In the field of traffic light assemblies, a number of different ways of fastening the traffic light assembly to a vertical pole or to a generally horizontal mast are used. Brackets holding the traffic light have been fixed to vertical poles, for example, by stainless or galvanized steel bands applied by banding tools. Once fixed by this method, however, their position cannot be altered without actually severing the band, repositioning the bracket, and applying new banding. Another way to attach brackets for traffic lights is by using U-bolt assemblies. Therefore, to accommodate poles of different diameters, it is necessary to keep a considerable inventory of different-sized U-bolts. It is also necessary to keep a large inventory of different U-bolts for poles or masts which taper so as to allow the traffic light assembly to be located at any desired point on them. When a traffic light assembly has been mounted on a vertical pole or on a horizontal mast, it is common practice to aim the traffic light assembly or orient it for optimum visibility with respect to the on-coming traffic. Moreover, even when the installer has located the traffic light in one spot, a government inspector may later require it to be moved to a different place. When the light has been installed by steel bands as stated above, it is then necessary to sever the band and replace it. If U-bolts were used, a considerable amount of additional labor and possibly different sized U-bolts may be required to change the location of the traffic light assembly or adjust it to the proper angular (vertical) position. The weight of the traffic light assembly on a long horizontal mast often produces a torque effect resulting in displacement of the assembly from the proper vertical position.

It is therefore among the objects of the invention to provide a mounting means for traffic light assemblies, signs, etc., which can be easily modified in length to account for different diameters of poles or masts.

It is also among the objects of the present invention to provide an articulated mounting means for traffic light assemblies and the like which does not require the maintenance of a large inventory of different-sized U-bolts and which can be simply readjusted by an installer in the field should circumstances so require. Other objects of the invention will appear from perusal of the drawings and the specification which follows.

SUMMARY OF THE INVENTION

An assembly for mounting an object to a support having a first member adapted to be connected to said object, the first member including at least one aperture to which fastening means may releasably be attached and also including first and second coupling means, first and second pluralities of links, selected ones of said links being releasably and pivotally coupled to one another, each of said plurality of links also being coupled to a corresponding one of said first and second coupling means, and means at the ends of said first and second pluralities which are not respectively coupled to said first and second coupling means for releasably coupling said ends together.

DETAILED DESCRIPTION OF THE DRAWINGS

Figures 1, 2, 3, 4, 5:
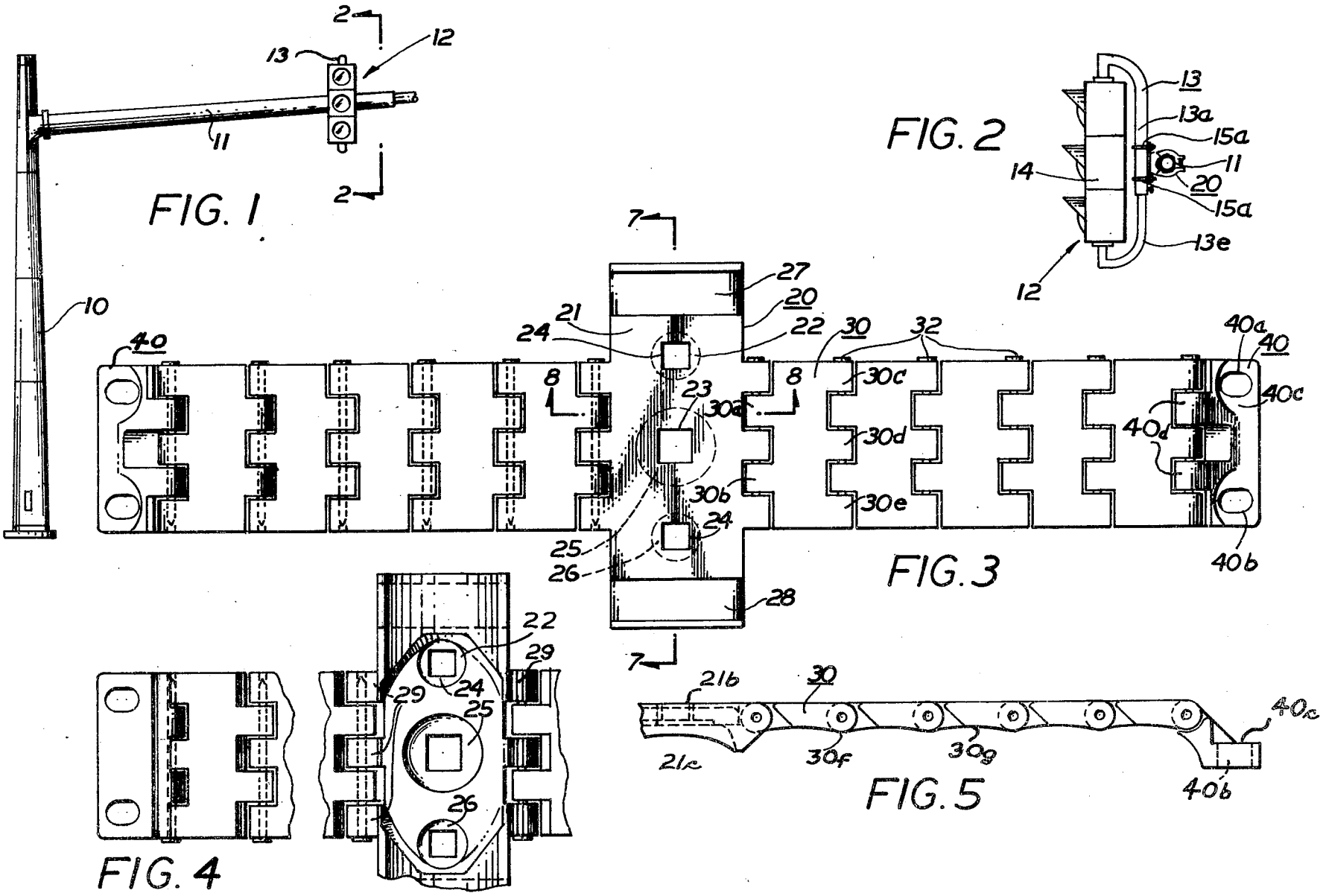
FIG. 1 is a side elevation view showing the environment in which the present invention has many applications.
FIG. 2 is an side view of a traffic light assembly bracket mounted using the invention as described herein. This view is taken along the section lines 2—2 of FIG. 1 in the direction indicated.
FIG. 3 is a laid-out view of the novel mounting means according to the present invention.
FIG. 4 is a fragmentary view of part of the apparatus shown in FIG. 3 as viewed from the bottom thereof.
FIG. 5 is a side elevation view of the part of the invention shown in FIG. 3.

FIG. 1 shows a traffic signal assembly 12 held by a bracket 13 which is mounted upon a generally horizontal mast 11 fixed to a vertical pole 10.

Figure 6:
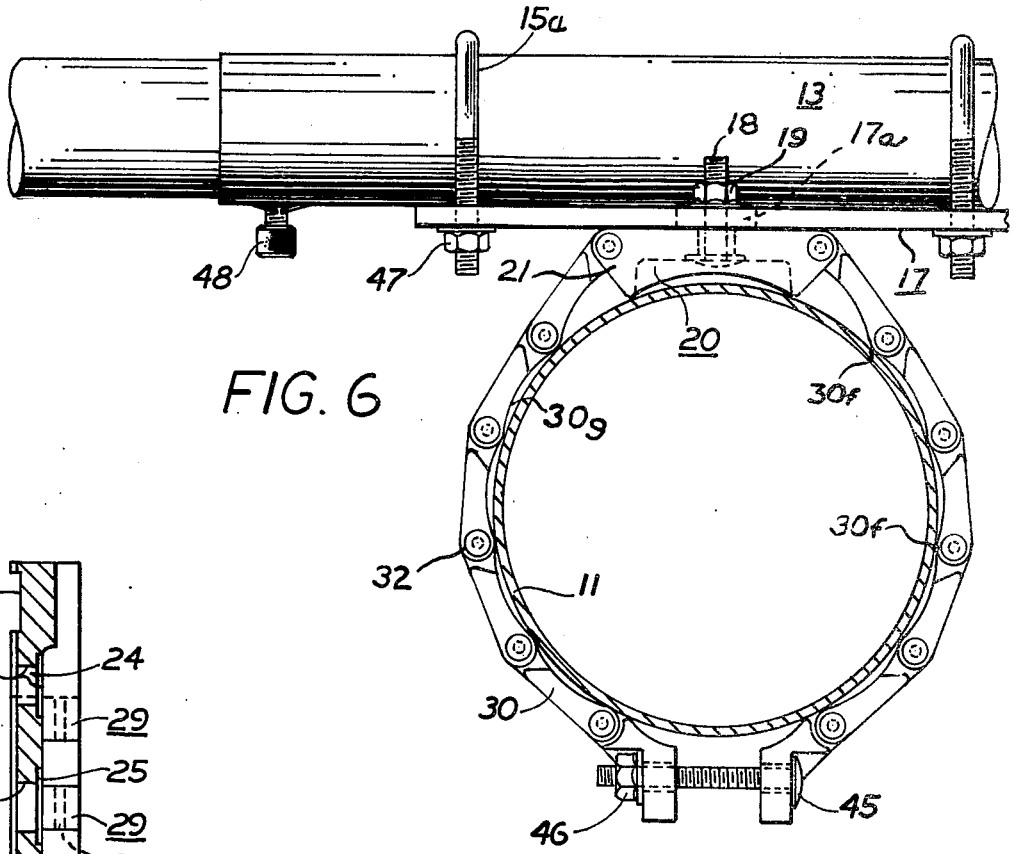
FIG. 6 is an enlarged fragmentary view of the mounting means according to the present invention.
Figure 7:
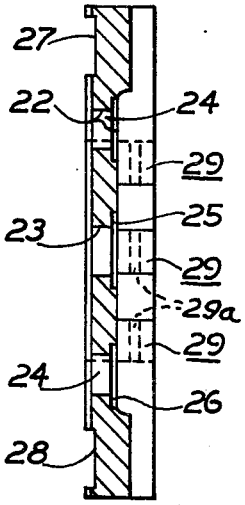
FIG. 7 is a sectional view of the central member of the apparatus shown in FIG. 3 taken along the section line 7—7 in the direction indicated.
Figure 8:
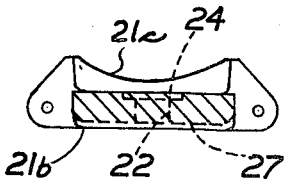
FIG. 8 is a sectional view of the central member of the invention as depicted in FIG. 3 taken along the section line 8—8 in the direction indicated.

FIG. 2 shows that the housing 14 of the traffic signal assembly 12 is connected at the top and bottom of a generally C-shaped bracket 13 consisting of a top portion **13*a* and a bottom portion 13*e* telescoping within the generally larger diameter portion 13*a* as described in U.S. Pat. No. 4,010,925 issued to the present inventor on Mar. 8, 1977. The bracket 13 is, in turn, held by two U-bolts 15*a* whose ends pass through apertures in a plate 17 which may be more readily seen in the enlarged detailed view in FIG. 6. To the plate 7 the novel articulated mounting assembly indicated generally at the numeral 20 in FIGS. 2 and 6 is attached by means of two bolts 18, which may be carriage bolts, for example, that pass through the top and bottom apertures 24 as shown in FIGS. 3 and 4. The bolts are fastened in place by means of nuts 19** which may be of the self-locking type, for example.

The mounting assembly 20 consists of a number of links 30 attached to either side of a central saddle member 21. The other ends of the links 30 are connected to respective coupling means which include the members 40 and the bolt-nut pairs 45, 46 that are passed through the apertures **40*a* and 40*b***.

As may be seen from FIG. 6, each of the links 30 has an inside protuberance near its pivot point which bears against the outer surface of the horizontal pole 11. Each link 30 also has a concave portion **30*g* which may be, for example, formed by a radius of, for example, 1¾". All of the links 30 are pivotally coupled to one another by a number of rigid pins 32. The pins 32 join adjacent links 30 by passing through ears 30*c*, 30*d* and 30*e* on one side of the link and ears 30*a* and 30*b* on the other, the ears being constructed to interdigitate with one another. The pins 32 have a slightly larger cross-section than the axial passages in the ears so that when they are driven in by force, they are maintained therein by friction fit. The innermost ears 30, that is the ones closest to the saddle or central member 21, are coupled pivotally by the pin 32 to the ears 29 symmetrically disposed on either side of the saddle 21. The dimensions of the links 30 are so chosen that, for example, each additional link 30 increases the internal diameter of the mounting assembly 20** by a given increment such as ½" when the assembly is disposed about an object having a generally circular cross-section.

Depending upon the diameter of the mast 11, a particular number of links 32 are chosen on either side of the saddle 20 and then the coupling members 40 are pivotally attached to the last link 30 on either side. The coupling or termination members 40 have a generally flat portion **40*c* in which slightly oval apertures 40*a* and 40*b* are formed to allow the passage of botls 45 through them. The members 40 also include ears 40*d* which are substantially identical to the ears of 30*a* and 30*b* of the links 30 so that they may also be pivotally coupled to the last (outermost) links 32 on each side of the saddle 21**.

As seen in FIGS. 3, 5, 6, 7 and 8, the outer surface of the saddle 21 is generally flat and most of it is in contact with one side of the plate 17. The opposite, inside surface **21*c* is curved inward as shown. The inside surface also has two depressed or countersunk areas 22 and 26 respectively located around the upper and lower apertures 24. There is also a corresponding countersunk area 25 surrounding the central aperture 23**.

It is seen that with this novel articulated mounting assembly 20 only a certain amount of saddles 21, terminal coupling portions 40, and links 30 need be kept in inventory since, by judicious addition or removal of the links 30 it will accommodate many different sized masts or poles. Furthermore, once the articulated mounting assembly 20 has been placed around the mast 11 and the bolts 45 have been tightened, the location of the mounting assembly may easily be changed with respect to the mast 11 by simply unscrewing the bolts 45 somewhat, sliding the assembly 20 along the pole and then tightening the bolts 45 once again. Furthermore, if the plate 17 is fitted with several holes **17*a* or arcuate holes, the verticality of the signal 12 may be adjusted when viewed from the ground to compensate for the slight upward angle of the mast 11. This is done by merely unscrewing the nuts 19 (FIG. 6) somewhat and then rotating the plate 17 in its own plane, and then screwing the nuts 19 tight once again. The use of a single bolt through central aperture 23 to mount the plate 17 to the saddle 21 offers an alternate way to adjust verticality of the signal by movement of the plate 17** in its own plane even if the plate does not have arcuate holes in it.

The assembly 20 may be made of cast aluminum thereby preventing the formation of detrimental electrolytic decay when used with aluminum poles or with galvanized steel surfaces which have been, for one reason or another, abraded or scratched hence rendering that part liable to rusting.

Figure 9:
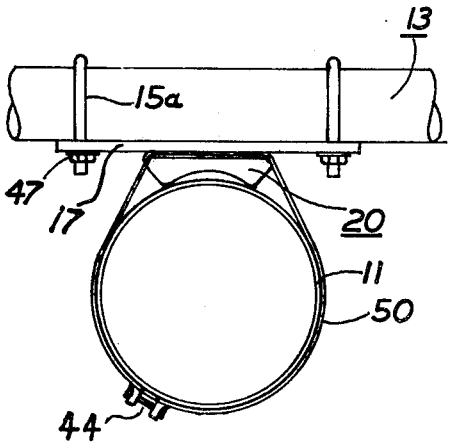
FIG. 9 is a plan view of the central member of the apparatus shown in FIG. 3 used in a slightly different way to couple a traffic light assembly to a pole or mast.

It may also be seen from FIGS. 3, 4, 7, and 9 that the saddle 21 is provided with transverse rectangular grooves 27 and 28. In addition to its use as the intermediate saddle member of the assembly 20, the member 21 may also be used by itself in certain instances as shown in FIG. 9. Steel bands 50 are passed around the mast 11 and in the grooves 27 and 28 and are fixed at their ends by any appropriate means indicated generally at the numeral 44.

What is claimed is:

1. An assembly for mounting an object to a support comprising:

(a) a first member having a substantially flat surface adapted to be brought into contact with said object, said first member including one or more apertures to which fastening means may releasably be attached, said first member also including first and second coupling means spaced from one another, (b) first and second pluralities of substantially identical one-piece molded links each of which has interdigitating portions which engage corresponding portions of the next-adjacent link, first ends of each of said plurality of links being respectively hingedly coupled to one of said first and second coupling means, selected ones of said links being releasably and pivotally coupled to one another by manually removable pins associated with said corresponding portions, (c) means at the second ends of said pluralities of links for releasably coupling said second ends together, a selected number of said links having inwardly projecting portions adapted to make contact with the surface of said support when said (c) means couple said second ends together, said selected number of links also having portions adjacent said inwardly projecting portions shaped so as not to make contact with the surface of said support when said (c) means couples said first ends together.

2. The assembly according to claim 1 wherein each of said identical links has one surface substantially flat and the surface opposite curved inwardly.

3. The assembly according to claim 1 wherein said first and second coupling means for said first member are positioned toward opposite edges of said first member and wherein a portion of the second surface of said first member opposite said substantially flat surface is concave.

4. The assembly according to claim 3 wherein said second surface of said first member has a plurality of projecting portions adapted to make contact with the curved surface of said support and said concave portion does not make contact with said support.

5. The assembly according to claim 1 wherein said portions of said links adjacent said projecting portions are concave and have dimensions such that each additional link adds substantially the same increment to the internal diameter of the assembly when said means for releasably coupling said second ends join said second ends together.

6. The assembly according to claim 2 wherein all of the links of said first and second pluralities are substantially identical.

7. The assembly according to claim 1 wherein said (c) means comprises two substantially identical apertured members whose apertures may be substantially aligned when said assembly is positioned around said support.

8. The assembly according to claim 1 wherein said first member includes a selected number of parallel transverse grooves formed in said flat surface thereof for engaging a selected number of strapping means for fastening said first member to said support.

9. The assembly according to claim 10 wherein said grooves are formed in said flat surface in portions thereof extending laterally outward from the pluralities of links.

10. The assembly according to claim 3 wherein the concave portion of said first member includes at least one countersunk aperture.

11. The assembly according to claim 1 wherein each of said links includes n projections on one edge having aligned apertures therein to receive one manually removable pin and n-1 projections on the opposite edge having aligned apertures therein to receive another manually removable pin, the projections on each edge being located to enable them to be interdigitated with the projections of the adjacent links for pivotal movement.

* * * * *